United States Patent [19]

Radzun

[11] 4,203,282

[45] May 20, 1980

[54] ELECTRIC PENDULUM CLOCK WITH TORSION SPRING

[76] Inventor: Bruno Radzun, Steibewies 7, 7022 Gottmadingen, Fed. Rep. of Germany

[21] Appl. No.: 926,202

[22] Filed: Jul. 19, 1978

[30] Foreign Application Priority Data

Jul. 20, 1977 [DE] Fed. Rep. of Germany ..... 2732667

[51] Int. Cl.[2] ..... G04B 17/10

[52] U.S. Cl. ..... 368/180

[58] Field of Search ..... 58/29, 129, 130 A, 132

[56] References Cited

U.S. PATENT DOCUMENTS

| | | | |
|---|---|---|---|
| 1,868,941 | 7/1932 | Herschede et al. | 58/129 |
| 3,802,181 | 4/1974 | Marquis | 58/129 |

*Primary Examiner*—Edith S. Jackmon

*Attorney, Agent, or Firm*—Hanes, Roberts, Spiecens & Cohen

[57] ABSTRACT

An electrical pendulum clock comprising a clock movement having a driven shaft and a dummy pendulum driven from the shaft independently of the timekeeping function of the clock. The pendulum comprises a torsion spring with a vertical axis of twist and a pendulum body suspended at the lower end of the torsion spring. The torsion spring has a radial projection which undergoes pendulous travel with the pendulum under the drive from the shaft of the clock movement. For this purpose a first toothed element is driven in rotation by the shaft of the clock movement and a turnable element is loosely suspended for pendulum movement on the shaft. The turnable element loosely carries a second toothed element on a shaft extending parallel to the shaft of the clock movement, the second toothed element being in mesh with the first toothed element. The second toothed element is positioned in the path of travel of the radial projection on the torsion spring for being locked with the turnable element to then undergo angular movement with the first toothed element to initiate the pendulous movement of the pendulum body via the projection and the torsion spring. After a given degree of angular movement of the turnable element, the latter is released from the radial projection and the pendulum body continues its pendulous movement while the turnable element now returns to an equilibrium position to await the return of the projection upon completion of one cycle of pendulous movement of the pendulum body.

24 Claims, 8 Drawing Figures

ELECTRIC PENDULUM CLOCK WITH TORSION SPRING

FIELD OF THE INVENTION

This invention relates to an electric pendulum clock with dummy pendulum which is disconnected from the regulator of the clock movement and has a torsion spring and a pendulum body suspended from same, and with a driving pin or the like which protrudes from the torsion spring and the point of which extends into the path of movement of a member adapted to be driven by the clock movement in order to bring about the twisting process of the torsion spring, said point being moved approximately periodically by said member partially around the axis of the torsion spring.

PRIOR ART

Such pendulum clocks having merely a decorative or dummy torsion pendulum have replaced the conventional one-year clocks, the particular virtue of which once resided in their winding period of about 400 days. Upon the transition to electric drives for pendulum clocks the pendulum was retained as a decorative element, it customarily consisting of a flexible metal band of a thickness of about 0.08 mm and a width of about 0.9 mm as a torsion spring and of a pendulum body consisting of several heavy metal balls. With a relatively strong tension spring, the force from the spring housing of the clock movement—strongly stepped down via a gear train—is transmitted by the interaction of a special escapement system to the torsion pendulum. The connection between the latter and the escapement system is customarily effected by an arm on the pallet, the so-called guide needle which extends at right angles from the torsion spring. Upon each movement of the pallet, the needle moves alternately to the right or to the left carrying the torsion spring along with it and thus also the pendulum body which—once placed in rotation—requires only a slight impulse in order to retain its movement.

The torsion spring twists over its entire length up to an end position from which it then twists back into the starting position, the needle being carried along. In this way the pallet releases a new tooth on the escapement wheel and the drive swings towards the other side. For a one-year clock one can assume that the pendulum carries out eight swings a minute and therefore uses 7.5 seconds for a single swing to one side. Therefore a relatively heavy pendulum is required, the mass of which will be located as far as possible in the outer region of the diameter. The most customary shape in this connection is the known ball pendulum, the weights of which in the case of small clocks, are formed as solid brass balls and in the case of large clocks generally as lead balls covered with polished shells. The weight in this connection is about 50 grams a ball, four balls generally sitting on a supporting spider suspended from the torsion spring. A correction screw is provided on said spider by means of which the weights can be moved closer to or further from the axis so as thereby to shift the center of gravity of the mass of the pendulum in accordance with the requirements. One-year clocks require several such corrections at the place where they are finally set up. If this is done by laymen the torsion spring is frequently deformed, if not broken. Even slight bends of the fork which holds the needle to the torsion spring can so change the position thereof that the clock stops.

This cumbersome correction work was done away with in the case of battery-operated clock movements. The power pulse is used to drive the dummy pendulum from the clock movement via a drog-spring mechanism, for instance with the use of the mechanical pallet escapement system of the mechanical one-year clock; this results in a substantial lack of economy in manufacture and a complicated escapement system.

Another development was the electric one-year clock having a completely separate electronically controlled drive from the base of the clock and separate source of current, in which case the pendulum had to be additionally supported. Aside from the high consumption of energy for the pendulum as a result of the additional friction, the cost as a whole was very substantial.

In a commercial clock of the aforementioned type the torsion spring consists of the steel band which is clamped at its upper end and a multi-ball pendulum body supported by said band. Near the clamped end of the steel band the needle protrudes, its tip contacting a cam driven by the clock movement. In order to permit an equalization of movement between the clock movement proper and the cam, there is provided a detent coupling with an adjustable gear wheel, which coupling is disengageable by the drive force of the clock movement, the gear wheel being swingable due to the drive force of the clock movement against a force which assures the engagement of the gear wheel with another gear wheel which is supported for fixed rotation. The displaceable gear wheel is arranged on a rocker which is swingable around the pivot point of the shaft bearing the cam and the displacement of which is limited by stops.

SUMMARY OF THE INVENTION

In view of the foregoing the inventor set himself the goal of creating a new pendulum clock of the aforementioned type which, on the one hand, has an uncomplicated mechanism and, on the other hand, permits the use of disproportionately light pendulums. Additional gear parts and coupling elements are avoided and the selection of the material is considerably broadened.

This goal is achieved by the construction in which a turning part which is suspended for pendulum movement on the shaft of the clock movement bears a gearwheel or the like supported with play which engages with a toothed disk or the like turned by the clock movement, and into the path of movement of which there extends the needle which periodically fixes the gear wheel on its axis and can be driven together with it by the toothed disk on the latter's periphery. In this connection toothed disk and gear wheel should preferably be arranged on a common shaft.

As a result of this construction only two drive wheels are now needed for the release of the pendulum drive, namely predominantly the toothed disk and the gear wheel; additional coupling elements of complicated construction are entirely done away with. In addition, the needle does not have to carry out any work here but serves essentially as a detent member by cooperation with the gear wheel.

Only as a result of this development of the pendulum drive is it possible to employ instead of the sensitive metal pendulum spring, in accordance with another feature of the invention, a strand of plastic foil or plastic threads of slight axial stretchability, which makes it possible to dispense with heavy pendulum balls; thus in accordance with the invention hollow balls can now be used as pendulum bodies, and these balls may even be formed of plastic. Light pendulums of the kind in accordance with the invention assure gentle and quiet movement of the pendulum.

As the material for the torsion spring or torsion strand it has been found suitable to use polyesters or polyamides of linear structure which after spinning from a melt or forming into a foil have been subjected possibly to a stretching process in order to keep the length of the pendulum as constant as possible. Of course, any other type of torsion strand having a base of plastic also lies within the scope of the invention.

In accordance with another feature of the invention, there is seated on the shaft a bearing part on which the toothed disk is fastened and from which the turning part is loosely suspended; this bearing part, in the one hand, assures a dependable seat on the shaft and, on the other hand, permits an easier assembling of the clock movement on the one hand and pendulum drive on the other hand.

In accordance with the invention, the turning part of the pendulum drive is formed as a centrally supported angle piece having a weight arm and a supporting arm for the shaft of the gear wheel, which suporting arm is held in a position of equilibrium by the weight arm. The two arms advantageously form an angle of about 120° with each other.

The preferred equilibrium position of the angle piece is obtained when the supporting arm forms an angle of about 30° with the vertical pendulum line and the weight arm lies on the other side of the pendulum line.

The needle which determines a horizontal path of movement around the torsion spring engages, in accordance with the invention, in one of the grooves between the gear wheel teeth, and presses the gear wheel against its shaft in such a manner that the friction produced between the latter and its gear wheel is greater than the thrust force on the periphery of the toothed disk; the gear wheel now moves along the tooth disk and carries the needle with it up to beyond a line determined by the horizontal projection of the torsion spring on its drive and the needle then detaches itself from the gear due to the twist of the torsion spring which has been brought about.

In order to assist in this process, an additional pressure arm extends approximately parallel to the supporting arm, the pressure arm being directed approximately tangentially to the groove bottom between the teeth of the gear wheel and assisting in the displacement of the needle. The use of this pressure arm furthermore has the advantage that the supporting arm can remain relatively narrow so as to save weight.

In another embodiment, the turning part is designed as a strap which hangs as a pendulum around the shaft and points vertically downward in its equilibrium position.

In the event that the needle tries to push the turning part beyond its equilibrium position, a stop protruding from the housing is provided on the side of the turning part facing away from said needle, this stop additionally assisting in the operability of the device.

In order in case of an unexpected loading of the torsion spring not to endanger the supporting arms which hold it at its upper end, it is furthermore proposed to provide these supporting arms with a folding device, for instance a wide notched groove so that the supporting arms follow for a short time the downward acting force; this folding device prevents the breaking of the supporting arms and forms an additional safety device in operation.

BRIEF DESCRIPTION OF THE DRAWINGS

Other advantages, features and details of the invention will become evident from the following description of preferred embodiments given with reference to the drawing in which.

DETAILED DESCRIPTION

Figure 5:
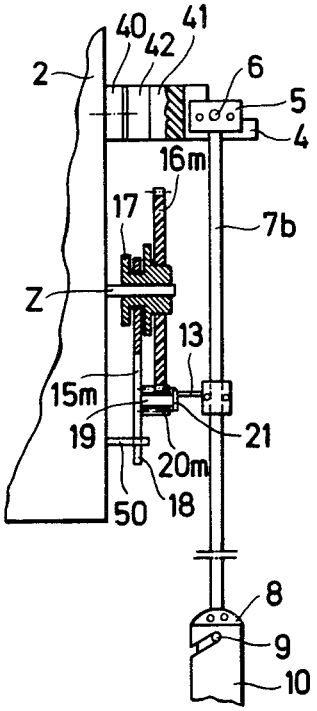
FIG. 5 is an elevation view of a detail of another embodiment.

On the rear side of the dial of a torsion pendulum clock R there is provided a housing 2 for a clock movement, not shown, electronically controlled by a battery 3. A torsion spring consisting of a plastic thread 7 or, as shown in FIG. 5, a plastic band $7_b$, is suspended from the clock-movement housing 2 between two bearing arms 4 on a clamping member 5 with transverse bolt 6.

At the other end of the torsion spring 7 there is fastened another clamping member 8 with transverse pin 9 (FIG. 5) on which the coupling hook 10 of a pendulum body 11 rests in disengageable fashion. This pendulum body with four hollow pendulum balls 12 fastened to it forms merely a decorative element which does not affect the regulation of the clock movement.

From the torsion spring 7 there protrudes a needle 13 which is clamped to it and the free end 14 of which extends into the path of movement of a turning part 15 seated on a shaft end Z of the clock movement.

On the shaft end Z there is firmly seated a drive wheel 16—for instance in the form of a plastic toothed disk—which—for instance when using solid pendulum balls 12 as the mass for a heavy pendulum—can be fixed by means of a suitable coupling element also via a frictional seat.

Figure 6:
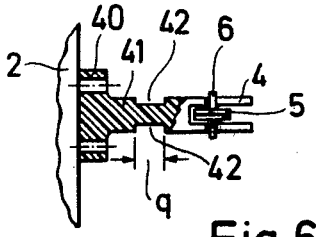
FIG. 6 is a partially sectioned top view of a part of FIG. 5.
Figure 7:
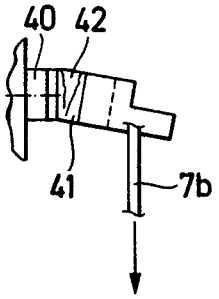
FIG. 7 shows a detail of FIG. 5 in a different position.

In the embodiment shown in FIGS. 5 to 7, plastic toothed disk $16_m$ is shrunk-fit onto a hub 17 of metal. On the latter there loosely rests a strap $15_m$ as a downward hanging turning part with free end 18. The turning part 15 supports, with play, on a shaft 19 extending approximately parallel to the shaft end Z a gear wheel 20 ($20_m$ in FIG. 5) which is held on the shaft 19 by a transverse yoke 21 or a corresponding machine part and meshes with the plastic toothed disk 16.

In the embodiment shown in FIGS. 1 to 4, the turning part 15 constructed as an angle piece consisting of two arms 25, 26 forming an angle u of about 120°, the shorter arm 26 bearing the gear wheel 20 on the shaft 19. A pressing web 27 which extends from the other arm 25 parallel to arm 26 encloses a blind slot 28.

Figure 1:
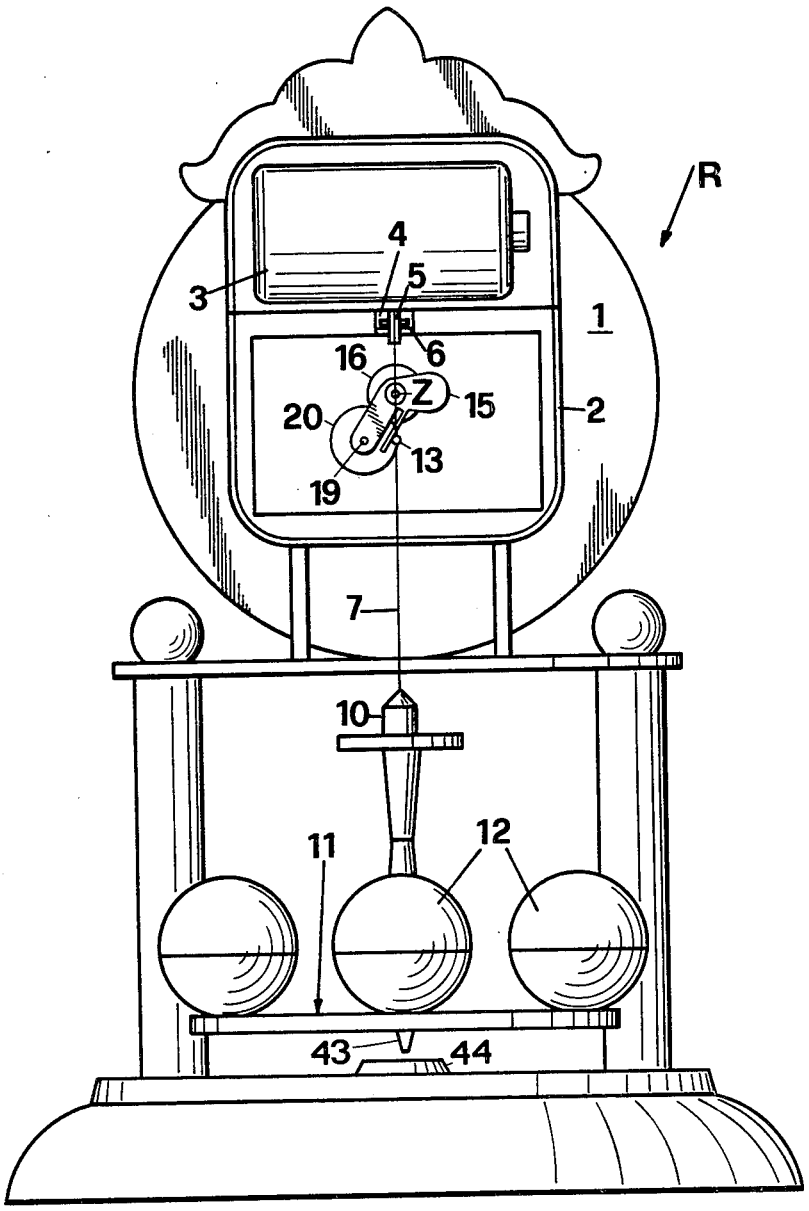
FIG. 1 is a rear view of an electric pendulum clock.
Figure 3:
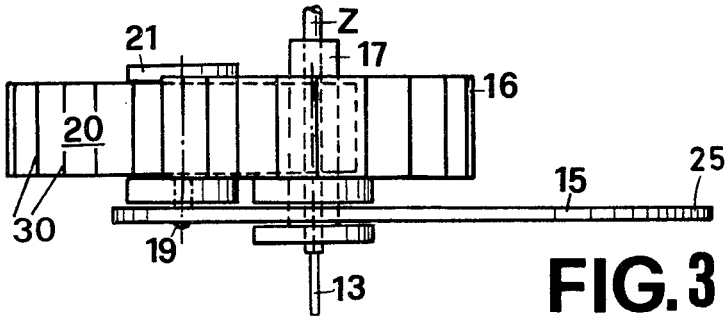
FIG. 3 is a top view of a detail in FIG. 2.
Figure 2:
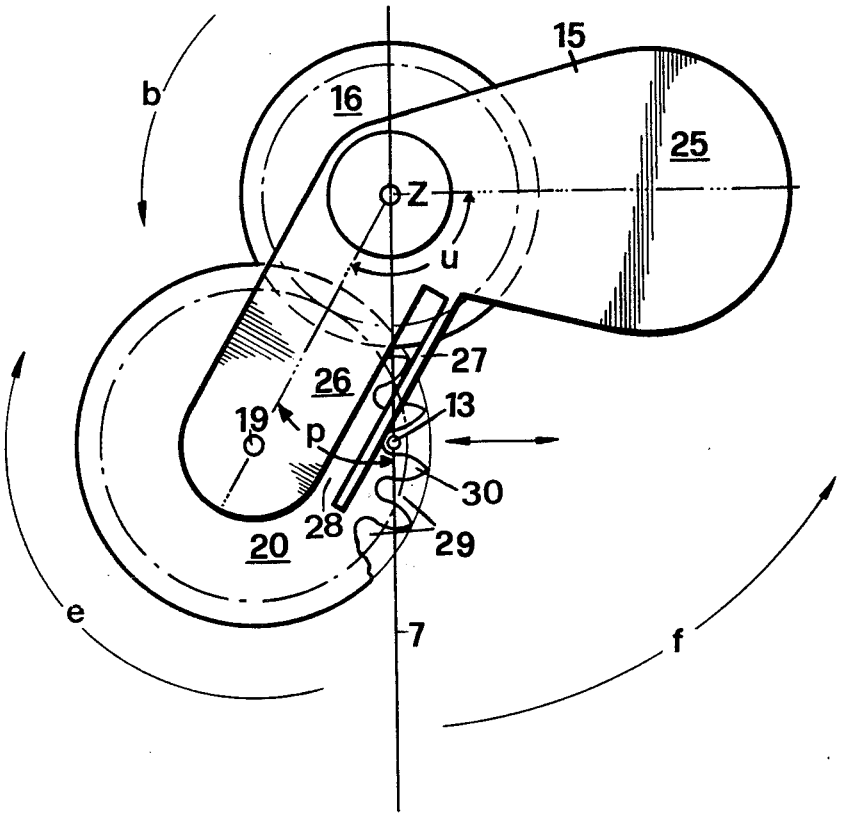
FIG. 2 shows a detail of FIG. 1 on a larger scale.

In the equilibrium position of the angle piece 15 shown in FIG. 2, its weight arm 25 holds the other arm 26 with gear wheel 20 in a position inclined at an angle p of about 30° to the vertical, without the toothed disk 16 which meshes with the gear wheel 20 carrying along with it the gear wheel 20 which is moved around its shaft 19 in the direction of rotation e.

In corresponding manner, in the embodiment shown in FIG. 5, the strap $\mathbf{15}_m$ hangs vertically in its equilibrium position and its gear wheel $\mathbf{20}_m$ turns loosely on the shaft 19 due to the force exerted by the toothed disk $\mathbf{16}_m$.

Figure 4:
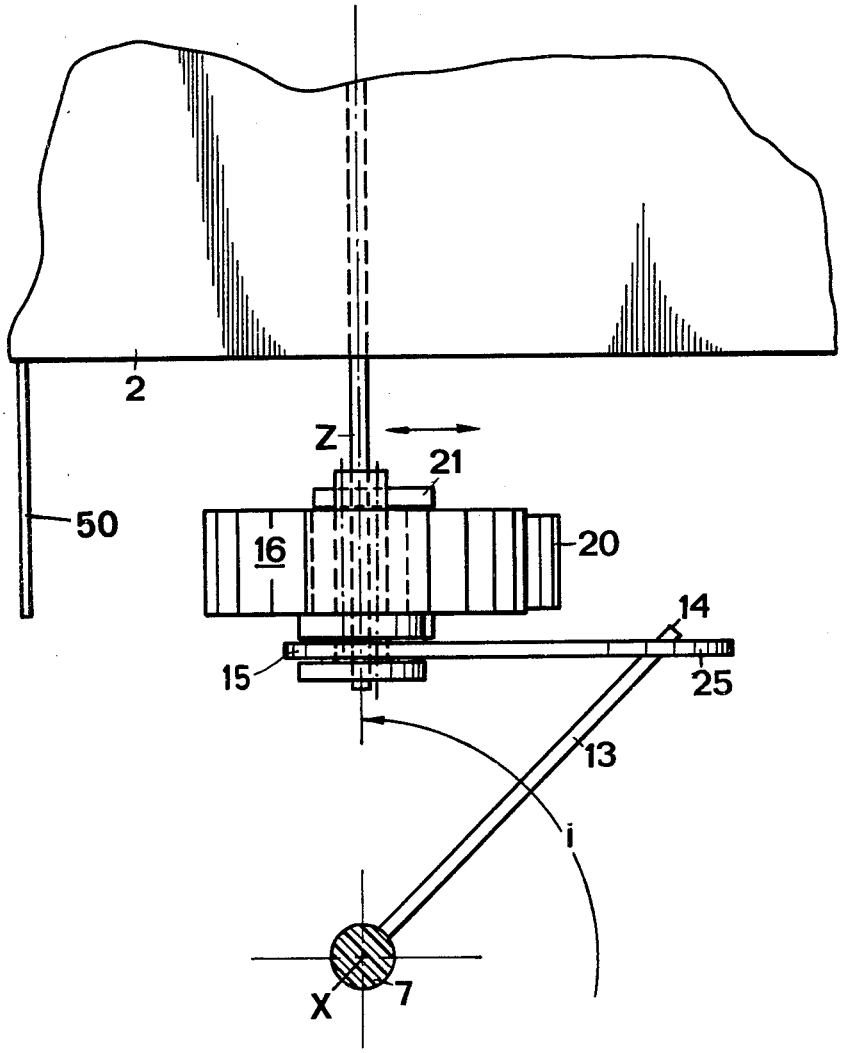
FIG. 4 is a showing corresponding approximately to FIG. 3 of said detail in a different position of use of certain parts.

As soon as the needle 13 which extends from the torsion spring 7 approaches the gear wheel 20, in traveling in the direction of arrow i in FIG. 4, and has placed itself into one of the recesses 29 between adjacent teeth 30, the gear wheel 20 which is now fixed in position is guided by said toothed disk 16 in the direction indicated by the arrow f (FIG. 2). In corresponding manner, in the embodiment of FIG. 5, the toothed disk 16 moves strap $\mathbf{15}_m$ with gear wheel $\mathbf{20}_m$ in the direction of rotation b (FIG. 2).

The point 14 of the needle 13 is carried along by the gear wheel 20, the needle 13 turning with the torsion spring 7 around the axis X of the latter—in the direction opposite the arrow i in FIG. 4. The twist introduced by this movement in the torsion spring, assisted by the pendulum body 11, brings the point 14 of the needle out of the gear wheel 20 and into a free (partial) circular movement of, for instance, 160°.

Each of the pendulum balls 12 of the pendulum body 11 describes in one direction of rotation a path of for instance 450° until the return path for the untwisting of the torsion spring again commences, at the end of which the point 14 of the needle again engages into the gear wheel 20.

As can be noted in particular from FIGS. 5 to 7, the two support arms 4 are formed as a single piece in order to receive the clamping member 5 of the torsion pendulum 7 and are fastened by a bracket 40 screwed to the rear wall of the housing 2 or inserted in a clamping manner (not shown) therein.

A collar 41 of plastic which extends between the two support arms 4 and the bracket 40 has, on both sides notches 42 of width q. If a downward directed force should unexpectedly act on the pendulum body 11 or the torsion spring 7, the collar 41 is temporarily deformed between the notches 42, approximately in accordance with the showing of FIG. 7, until a lower tip 43 of the pendulum body 11 engages in a detent socket 44 (FIG. 1) and stops the downward movement of the pendulum body 11. Due to these lateral notches 42, tearing of the torsion spring is prevented.

In order to prevent the displacement of the turning part 15 beyond its equilibrium position, a stop projection 50 is provided in the housing 2.

Figure 8:
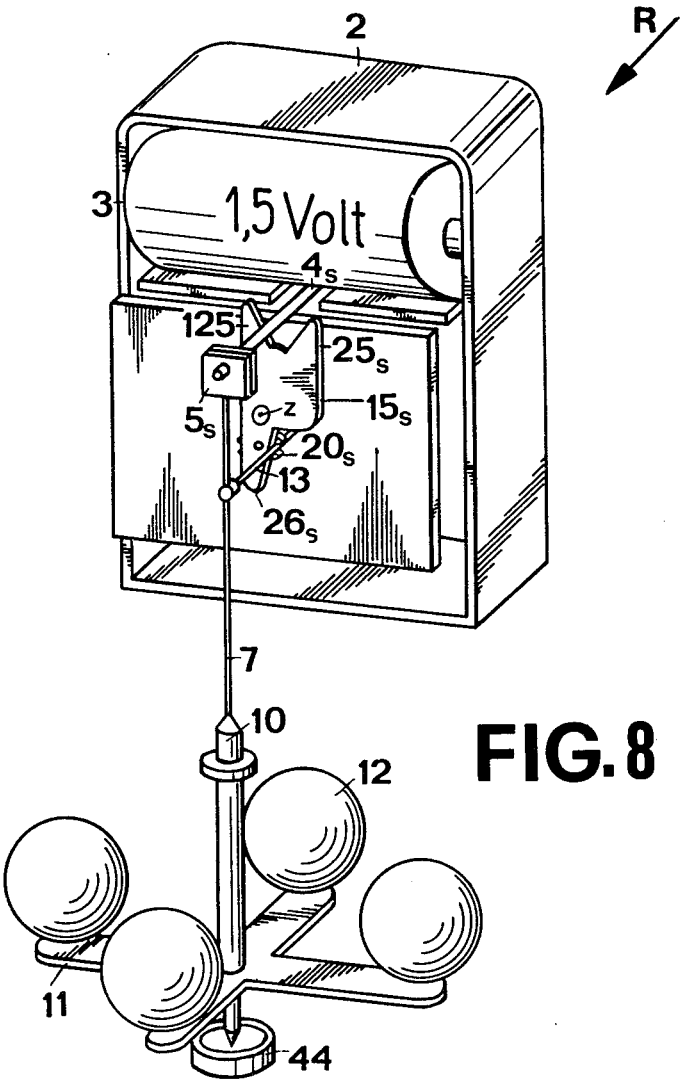
FIG. 8 is an enlarged rear view of a detail of another embodiment of the pendulum clock shown in perspective.

Furthermore:

FIG. 8 is an enlarged back view of a detail of another embodiment of the pendulum clock, shown in perspective view.

In this example, this turning part $\mathbf{15}_s$ is formed approximately in the shape of an "h", the downward pointing arm $\mathbf{26}_s$ of which bears a gear wheel $\mathbf{20}_s$ while the diagonally opposite arm $\mathbf{25}_s$ and another arm 125 extending approximately parallel thereto—in the rest position shown in FIG. 8—are arranged on both sides of a bar $\mathbf{4}_s$. The latter extends from the housing 2 and passes through the upper clamp piece $\mathbf{5}_s$ of the torsion spring which in this case is formed as a thin metal thread; the clamping piece $\mathbf{5}_s$ can easily be pushed over the extending bar $\mathbf{4}_s$—which results in a simplication of manufacture and assembly as compared with the examples previously described.

The turning part $\mathbf{15}_s$ can also be made more simply.

I claim:

1. In an electrical pendulum clock having a clock movement with a driven shaft and a dummy pendulum driven from the shaft independently of the time keeping function of the clock, the pendulum having a torsion spring with an axis of twist and a pendulum body suspended from the torsion spring, the torsion spring having a projection means adapted for being driven from the shaft of the clock movement and for undergoing pendulous travel with the pendulum body, the improvement comprising drive means driven by the clock movement for twisting the torsion spring including a first toothed element driven in rotation by the shaft of the clock movement, a turnable element loosely suspended for pendulum movement, a second toothed element loosely supported on said turnable element and in mesh with the first toothed element, said second toothed element being positioned in the path of movement of the projection means for being locked with the turnable element thereby, and then to undergo angular movement with the first toothed element to impart the pendulous movement to the pendulum body via the projection means and the torsion spring.

2. The improvement as claimed in claim 1 wherein said torsion spring is a strand of plastic material of relatively small axial stretchability.

3. The improvement as claimed in claim 2 wherein said strand is a foil of said plastic material.

4. The improvement as claimed in claim 3 wherein said plastic material has a polyester or polyamide base of linear structure.

5. The improvement as claimed in claim 1 wherein said pendulum body comprises plastic hollow balls.

6. The improvement as claimed in claim 1 wherein said turnable element is suspended on said shaft coaxially with the first toothed element.

7. The improvement as claimed in claim 6 comprising a bearing on said shaft to which said first toothed element is secured and in which said turnable element is loosely suspended.

8. The improvement as claimed in claim 1 wherein said turnable element comprises two radially extending arms, and a shaft on a first of said arms loosely supporting said second toothed element, the second of said arms being weighted to provide an equilibrium position for the turnable element in which the first arm is offset from the vertical.

9. The improvement as claimed in claim 8 wherein said arms define an angle of 120° therebetween.

10. The improvement as claimed in claim 8 wherein said turnable element is suspended on said driven shaft of the clock movement, said shaft on the first arm being parallel to said driven shaft.

11. The improvement as claimed in claim 10 wherein said first arm is inclined at an angle of 30° with respect to the vertical in said equilibrium position.

12. The improvement as claimed in claim 8 wherein said turnable element further comprises a pressure arm positioned for contact with the projection means on the torsion spring, said pressure arm extending substantially parallel to said first arm and substantially tangentially to the bottom of a tooth space between adjacent teeth of the second toothed element.

13. The improvement as claimed in claim 1 wherein said turnable element comprises a strap loosely supported on said driven shaft of the clock movement, said turnable element having a vertically suspended equilibrium position.

14. The improvement as claimed in claim 13 comprising stop means for limiting the angle of travel of said turnable element.

15. The improvement as claimed in claim 1 wherein said projection means travels substantially horizontally, said turnable element having a suspended equilibrium position in which said second toothed element is disposed such that a tooth space between adjacent teeth is disposed in the path of travel of said projection means.

16. The improvement as claimed in claim 1 comprising a supporting member with arms for supporting said torsion spring at one end thereof, said supporting member being provided with at least one groove extending parallel to said torsion spring to provide a folding zone upon application of axial force to said torsion spring.

17. The improvement as claimed in claim 1 comprising a housing for the clock member, a protruding member extending from said housing, and clamping means on said protruding member for clamping the torsion spring at the end thereof remote from the pendulum body.

18. The improvement as claimed in claim 17 wherein said turnable element has an "h" shape and extends in a plane parallel to the torsion spring, said turnable element including two parallel arms flanking said protruding member.

19. The improvement as claimed in claim 13 wherein said turnable element includes a third arm carrying said second toothed element in the path of movement of the projection means.

20. The improvement as claimed in claim 19 wherein the clock movement is battery driven, means being provided for supporting a battery to drive the clock movement at a location thereabove.

21. The improvement as claimed in claim 1 wherein said toothed elements are gear wheels, said projection means comprising an elongated pin extending from said torsion shaft and loosely engageable in a tooth space between adjacent teeth of the second toothed element.

22. The improvement as claimed in claim 1 wherein said projection means comprises an elongated pin extending perpendicularly from said torsion spring and including a tip portion engageable with said second toothed element.

23. The improvement as claimed in claim 2 wherein said strand comprises threads of said plastic material.

24. The improvement as claimed in claim 23 wherein said plastic material has a polyester or polyamide base of linear structure.

* * * * *